US005097598A

United States Patent [19]

Andreula

[11] Patent Number: 5,097,598

[45] Date of Patent: Mar. 24, 1992

[54] APPARATUS AND METHOD FOR GROOMING AND TREATING NATURAL EYELASHES

[76] Inventor: Linda A. Andreula, 60 Hillcrest Ave., Lodi, N.J. 07644

[21] Appl. No.: 667,763

[22] Filed: Mar. 11, 1991

[51] Int. Cl.[5] ..... B26B 13/00; A45D 2/48

[52] U.S. Cl. ..... 30/233; 132/217; 30/178; 30/184

[58] Field of Search ..... 30/233, 286, 179, 90.1, 30/178, 182, 184, 28; D28/36; 132/213, 216, 217, 223

[56] References Cited

U.S. PATENT DOCUMENTS 3,016,059 1/1962 Hutton ..... 132/217
3,517,673 6/1970 Kim ..... 132/217
4,305,412 12/1981 Mist ..... 132/217
4,993,439 2/1991 Davies ..... 132/217

FOREIGN PATENT DOCUMENTS 493071 5/1953 Canada ..... 132/217

*Primary Examiner*—Douglas D. Watts
*Assistant Examiner*—Paul M. Heyrana, Sr.
*Attorney, Agent, or Firm*—Samuelson & Jacob

[57] ABSTRACT

Apparatus and method for grooming and treating natural eyelashes by trimming the eyelashes for regrowth by cutting the eyelashes along a curve corresponding generally to the natural curve followed by the eyelashes arrayed along an eye, with all of the eyelashes in the array being cut simultaneously, so that regrowth of the eyelashes will produce thicker and longer eyelashes of enhanced appearance.

4 Claims, 1 Drawing Sheet

APPARATUS AND METHOD FOR GROOMING AND TREATING NATURAL EYELASHES

The present invention relates generally to personal grooming and pertains, more specifically, to the grooming and treatment of natural eyelashes.

The enhancement of the appearance of natural eyelashes has been the subject of cosmetic materials and devices for a very long time. The quest for the appearance of longer, more pronounced eyelashes has led to the development of a wide variety of cosmetic materials and devices for applying those materials to the natural eyelashes. In addition, numerous eyelash curling devices have been made available for curling, as well as crimping and otherwise treating natural eyelashes, for altering the appearance of the treated eyelashes.

I have discovered that by trimming the natural eyelashes, the eyelashes will tend to grow back thicker, fuller and longer and, in general, will have an enhanced appearance, even without applying those cosmetics available for enhancing the appearance of natural eyelashes. In addition, regular trimming and regrowth has been found to produce stronger eyelashes which are more amenable to crimping and curling, and which are better suited to the application of cosmetics for an even more enhanced appearance.

The present invention provides apparatus and method for grooming and treating natural eyelashes in accordance with my discovery and attains several objects and advantages, some of which may be summarized as follows: Enables the enhancement of the appearance of natural eyelashes utilizing a simplified apparatus and method; attains thicker, fuller and more aesthetically pleasing natural eyelashes without the need for the application of excessive cosmetic materials; develops natural eyelashes of enhanced appearance and having greater strength and durability; provides apparatus and method for enhancing the appearance of natural eyelashes with increased ease, rapidity and safety; enables even trimming of an array of eyelashes quickly and uniformly; and makes available an economical apparatus and method for widespread, everyday use in grooming and treating natural eyelashes.

The above objects and advantages, as well as further objects and advantages, are attained by the present invention, which may be described briefly as apparatus and method for grooming and treating natural eyelashes, the eyelashes being arrayed along a natural curve followed by the eyelashes of an eye, the apparatus and method comprising: means for and the step of trimming the eyelashes for regrowth by cutting the eyelashes along a curve corresponding gene ally to the natural curve along which the eyelashes are arrayed.

The invention will be understood more fully, while still further objects and advantages will become apparent, in the following detailed description of preferred embodiments of the invention illustrated in the accompanying drawing, in which.

Figure 1:
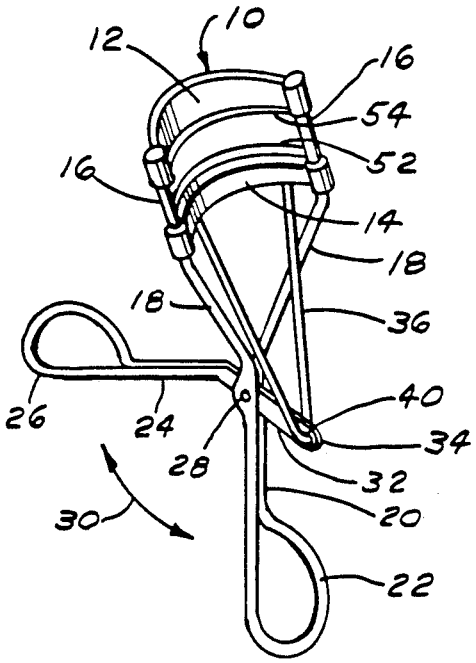
FIG. 1 is a perspective view of an apparatus constructed in accordance with the present invention.

Referring now to the drawing, and especially to FIG. 1 thereof, an apparatus constructed in accordance with the invention is illustrated generally at 10 and is seen to have a pair of opposed jaws in the form of an upper jaw 12 and a lower jaw 14. Upper jaw 12 is secured to parallel posts 16 so as to be integral with the posts 16, which posts 16, in turn, are unitary with a fork 18 which extends from a first operating handle 20 having a finger loop 22. A second operating handle 24 has a finger loop 26 and is connected to the first operating handle 20 at a pivot pin 28 so that the first and second operating handles 20 and 24 may be moved pivotally relative to one another in the directions indicated by arrow 30. A lever 32 is unitary with the second operating handle 24 and extends away from the pivot pin 28 to an end 34 which is coupled to the lower jaw 14 by means of a yoke 36 affixed to the lower jaw 14 at 38 and pivotally connected to the second operating handle 24 at journal 40, adjacent the end 34 of lever 32.

Figure 2:
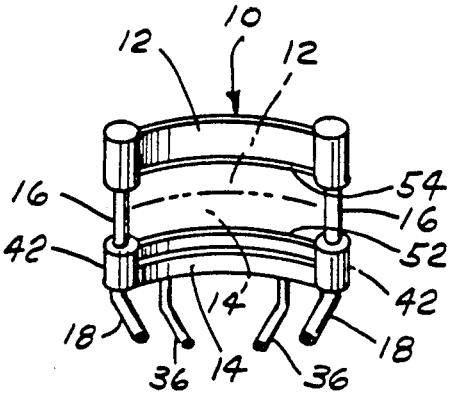
FIG. 2 is a fragmentary, essentially elevational view showing a portion of the apparatus.

As best seen in FIG. 2, as well as in FIG. 1, lower jaw 14 includes a bushing 42 at each end of the lower jaw 14, and each bushing 42 is mounted in sliding engagement with a corresponding post 16. Thus, movement of the operating handles 20 and 24 in the directions indicated by arrow 30 in FIG. 1 will move the opposed jaws 12 and 14 toward and away from one another between an open position, illustrated in full lines in FIG. 2, and a closed position, illustrated in phantom in FIG. 2, with the bushings 42 sliding along the posts 16 to maintain the jaws 12 and 14 in appropriate alignment.

Figure 3:
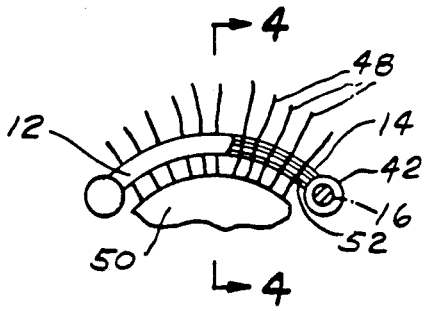
FIG. 3 is plan view, partially broken away, illustrating the apparatus and method of the present invention.
Figure 4:
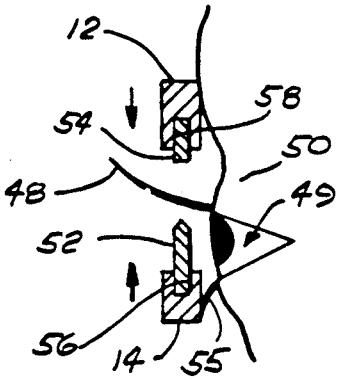
FIG. 4 is an enlarged cross-sectional view taken along line 4—4 of FIG. 3, showing the apparatus and the method of the invention.
Figure 5:
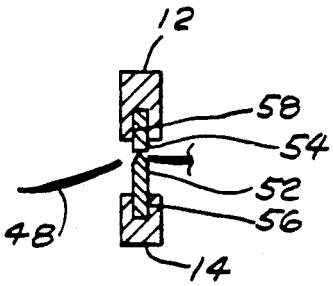
FIG. 5 is a cross-sectional view similar to FIG. 4, but with the component parts in another operating position to illustrate further the method, as well as the apparatus, of the invention.

Turning now to FIGS. 3 and 4, upper and lower jaws 12 and 14 are curved, in a manner similar to the construction of conventional eyelash curlers, to correspond generally to the natural curve followed by an array of natural eyelashes 48 of an eye 49, along an eyelid illustrated at 50. In accordance with the method of the invention, apparatus 10 is juxtaposed with eye 49 and eyelid 50, with the jaws 12 and 14 in the open position so that the array of eyelashes 48 is received between the jaws 12 and 14, as seen in both FIGS. 3 and 4. Upon appropriate location of apparatus 10 relative to eye 49 and, more specifically, relative to eyelid 50 of eye 49, and relative to the array of eyelashes 48, as shown, the operating handles 20 and 24 are moved toward one another about pivot pin 28 to move the opposed jaws 12 and 14 toward one another, and toward the closed position thereof. A cutting blade 52, carried by the lower jaw 14, is moved toward a platen 54, carried by the upper jaw 12, and severs the eyelashes 48 as the blade 52 reaches the platen 54, upon movement of the jaws 12 and 14 into the closed position, as seen in FIG. 5. The lower eyelashes 55 of eye 49 may be trimmed in a similar manner by following essentially the same procedure as outlined above.

The blade 52 is curved to correspond generally to the natural curve along which the eyelashes 48 and 55 are arrayed. Likewise, the platen 54 is curved to follow essentially the natural curve along which the eyelashes 48 and 55 are arrayed. In this manner, all of the eyelashes 48 or 55 in an array are severed simultaneously, so that the trimming of the eyelashes 48 or 55 in the respective array is accomplished evenly throughout the array and is done uniformly with ease, safety and rapidity. The curved arrangement of blade 52 and platen 54, and the corresponding jaws 12 and 14, promotes safety by enabling appropriate juxtaposition of the apparatus 10 with the eyelashes to be trimmed, without coming into contact with the eye 49 itself. Preferably, blade 52 is a one-piece continuous construction for uniformity in the cutting operation as well as for economy of manufacture and ease of replacement, as necessary. Should such replacement be necessary, blade 52 merely is withdrawn from complementary channel 56 in lower jaw 14 and is replaced. Likewise, platen 54 preferably is a one-piece continuous structure held in place in upper jaw 12 by means of a groove 58 in the upper jaw 12 and is replaced, as needed, by withdrawal from the groove 58.

Once the eyelashes are trimmed, as described above, I have found that upon regrowth, the eyelashes will be thicker and fuller, can be grown longer, and will have an enhanced appearance, even without the application of cosmetic materials. Regular trimming and regrowth has been found to produce stronger eyelashes which withstand curling and cosmetic applications much better than untreated eyelashes. Accordingly, it will be seen that the apparatus and method of the present invention enable improved grooming and treatment of natural eyelashes and attain the several objects and advantages set forth above, namely: Enables the enhancement of the appearance of natural eyelashes utilizing a simplified apparatus and method; attains thicker and more aesthetically pleasing natural eyelashes without the need for the application of excessive cosmetic materials; develops natural eyelashes of enhanced appearance and having greater strength and durability; provides apparatus and method for enhancing the appearance of natural eyelashes with increased ease, rapidity and safety; enables even trimming of an array of eyelashes quickly and uniformly; and makes available an economical apparatus and method for widespread, everyday use in grooming and treating natural eyelashes.

It is to be understood that the above detailed description of preferred embodiments of the invention is provided by way of example only. Various details of design, construction and procedure may be modified without departing from the true spirit and scope of the invention, as set forth in the appended claims.

The embodiments of the invention in which an exclusive property or privilege is claimed are defined as follows:

1. Apparatus for grooming and treating natural eyelashes, the eyelashes being arrayed along a natural curve followed by the eyelashes, of an eye, the apparatus comprising:

opposed jaws selectively movable toward and away from one another, said jaws being curved to correspond to the natural curve along which the eyelashes are arrayed so as to receive the eyelashes between the jaws when the jaws are away from one another wherein the opposed jaws comprise a pair of jaws movable between an open position and a closed position such that the eyelashes received between the jaws are cut simultaneously as the jaws are moved from the open position to the closed position, cutting means located along the curved jaws and carried by the curved jaws for movement therewith to cut the eyelashes received between the jaws upon movement of the jaws toward one another, the cutting means including a blade carried by one of the pair of jaws, and a platen carried by the other of the pair of jaws, the blade being opposed to the platen such that the eyelashes are received between the blade and the platen when the jaws are in the open position and the eyelashes are severed when the blade is more toward the closed position and into engagement with the platen.

2. The invention of claim 1 wherein the blade is curved to correspond generally to the natural curve along which the eyelashes are arrayed.

3. The invention of claim 1 wherein the platen is curved to correspond generally to the natural curve along which the eyelashes are arrayed.

4. The invention of claim 1 wherein the blade is curved to correspond generally to the natural curve along which the eyelashes are arrayed, and the platen is curved to correspond to the natural curve along which the eyelashes are arrayed.

* * * * *